United States Patent [19]

Kohl

[11] 4,220,020

[45] Sep. 2, 1980

[54] WARP KNITTING MACHINE WITH WEFT INSERTERS

[75] Inventor: Karl Kohl, Obertshausen, Fed. Rep. of Germany

[73] Assignee: Karl Mayer Textilmaschinenfabrik GmbH, Obertshausen, Fed. Rep. of Germany

[21] Appl. No.: 926,312

[22] Filed: Jul. 20, 1978

[30] Foreign Application Priority Data

Aug. 17, 1977 [DE] Fed. Rep. of Germany ..... 2736977

[51] Int. Cl.[2] ..... D04B 23/06

[52] U.S. Cl. ..... 66/84 A

[58] Field of Search ..... 66/84 A, 125

[56] References Cited

U.S. PATENT DOCUMENTS

| | | | |
|---|---|---|---|
| 1,680,614 | 8/1928 | Hill et al. | 66/84 A X |
| 3,797,278 | 3/1974 | Kohl | 66/84 A |
| 3,832,868 | 9/1974 | Derich et al. | 66/84 A |
| 3,916,649 | 11/1975 | Kohl | 66/84 A |

*Primary Examiner*—Ronald Feldbaum

*Attorney, Agent, or Firm*—Omri M. Behr; Martin Sachs

[57] ABSTRACT

A plurality of weft threads provided by stationary spools located at one side of a warp knitting machine are picked up by a thread transmission means and are presented to the needle bed of a warp knitting machine. The weft inserting apparatus is disposed within the space included by the needle bed, push rod and guide bar drive levers of the knitting machine.

1 Claim, 2 Drawing Figures

WARP KNITTING MACHINE WITH WEFT INSERTERS

BACKGROUND OF THE INVENTION

1. Field of the Invention

This invention relates generally to warp knitting machines, and more particularly, to a weft inserting apparatus for use on warp knitting machines.

2. Description of the Prior Art

The prior art abounds with many different types of weft inserting devices that are known to those of ordinary skill in the knitting machine art. Several of these are discussed in U.S. Pat. No. 3,916,649 to Karl Kohl. However, these include the following disadvantages: if the spools are required to be in motion, and there is weft breakage or the like, the complete weft inserting mechanism must be stopped; the threads must pass through long lever guides which cause undesirable friction forces and they tend to tear the threads; a "Figure 8" feed mechanism causes undesirable thread abrasion because the path of the thread from the spool to the thread guide is not in a straight and direct path; or a magazine type of arrangement which transfers the warp threads from a tensioning chain to a magazine and in turn, transfers the warp threads to the needle bed to be entrapped by the ground threads of the warp knitting machine includes additional driving mechanisms and chains increasing the chances of breakdown.

Thus, the prior art includes devices wherein a weft thread is extended the entire length of the machine by an angled thread transmission means which obtains the successive threads from a weft thread provider disposed on one side of the warp knitting machine. Prior art machines of this type also utilized weft thread magazines, which were adapted to receive the weft threads from the angle thread provider which provided the weft threads one after another, parallel to the needle bed of the machine, and then in turn, presented the weft threads to the needle bed at each predetermined stitch as desired.

In most cases, the prior art magazine included an arrangement having transport chains provided perpendicular to the needle beds disposed on both sides of the machine. The magazine was generally located on the rearward side of the needle bar. Since the guide bars had to be driven from both sides of the machine and the magazine driving mechanism which was required to have a transport driving means located on both sides of the machine also, it had to be contained within the available space. With limited space it was impossible to build magazines of very great width, or if relatively large widths were utilized, it was necessary to reduce the number of weft threads that were available for insertion. Also, the fact that the weft threads must pass through an additional mechanism such as a magazine, means must be provided to maintain thread cleanliness and means must be provided to prevent the loss of tension as the threads travel in a thread tensioning device.

The present invention overcomes the shortcomings found in the prior art by positioning the thread provider and the angled thread transmission means or carrier between the needle bed and the push rods which were used to activate the guide bar drive levers, thereby permitting an increased in the density of weft threads and the traditional magazine arrangement which requires the use of thread clips or retainers and other associated driving means can be eliminated.

A weft inserting apparatus, according to the principles of the present invention, for use with a warp knitting machine having a needle bed, guide bar drive levers, and push rods operatively connected thereto comprises, thread provider means for supplying a plurality of weft threads and includes means for sequentially carrying each of the weft threads across the width of the machine. The carrying means is angularly disposed towards the needle bed and is substantially within the space included by the needle bed, the push rods and the guide bar drive levers.

Other features of the present invention will be more fully understood with reference to the following drawings.

BRIEF DESCRIPTION ON THE DRAWINGS

FIG. 1 is a side elevation view of a warp knitting machine with the weft inserter disposed therein, according to the principles of the present invention; and FIG. 2 is a plan view of a warp knitting machine and weft inserter shown in FIG. 1.

DESCRIPTION OF THE PREFERRED EMBODIMENT

Figure 1:
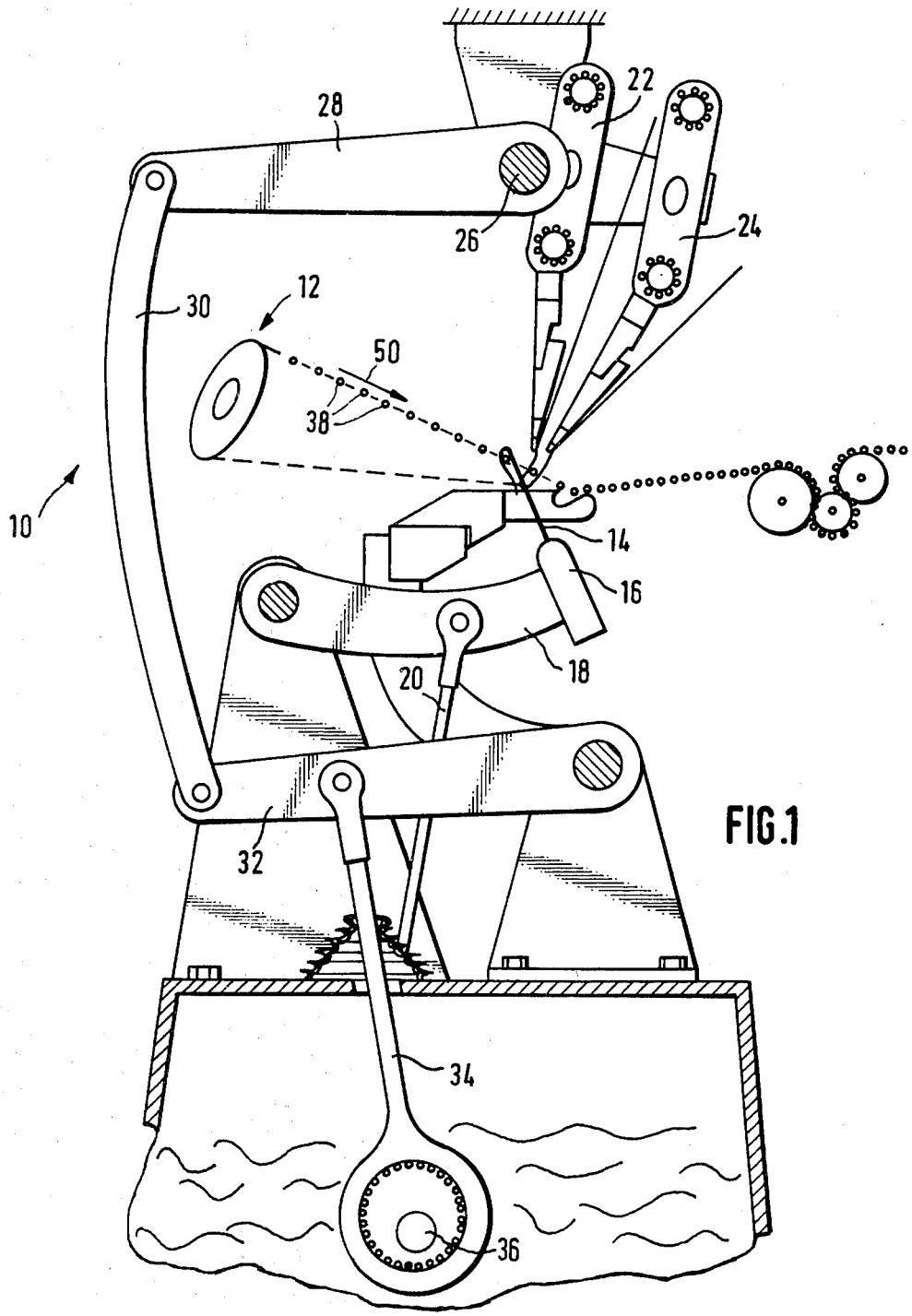

Refer now to the figures, and in particular to FIG. 1, which shows a side view in elevation of a warp knitting machine 10 with a thread transmission means or thread carrier means 12 disposed therein. The warp knitting machine 10 includes a needle bed 14 carried by the needle bar 16 which in turn is connected to drive lever 18 driven by push rod 20. The guide bars 22 and 24 are coupled to shaft 26 which is activated by drive lever 28, which in turn is activated by push lever 30. Push lever 30 is operated by drive lever 32 which is activated in turn by drive push rod 34. The drive push rod 34 is coupled by means of shaft 36 to the source of driving power, not shown.

Figure 2:
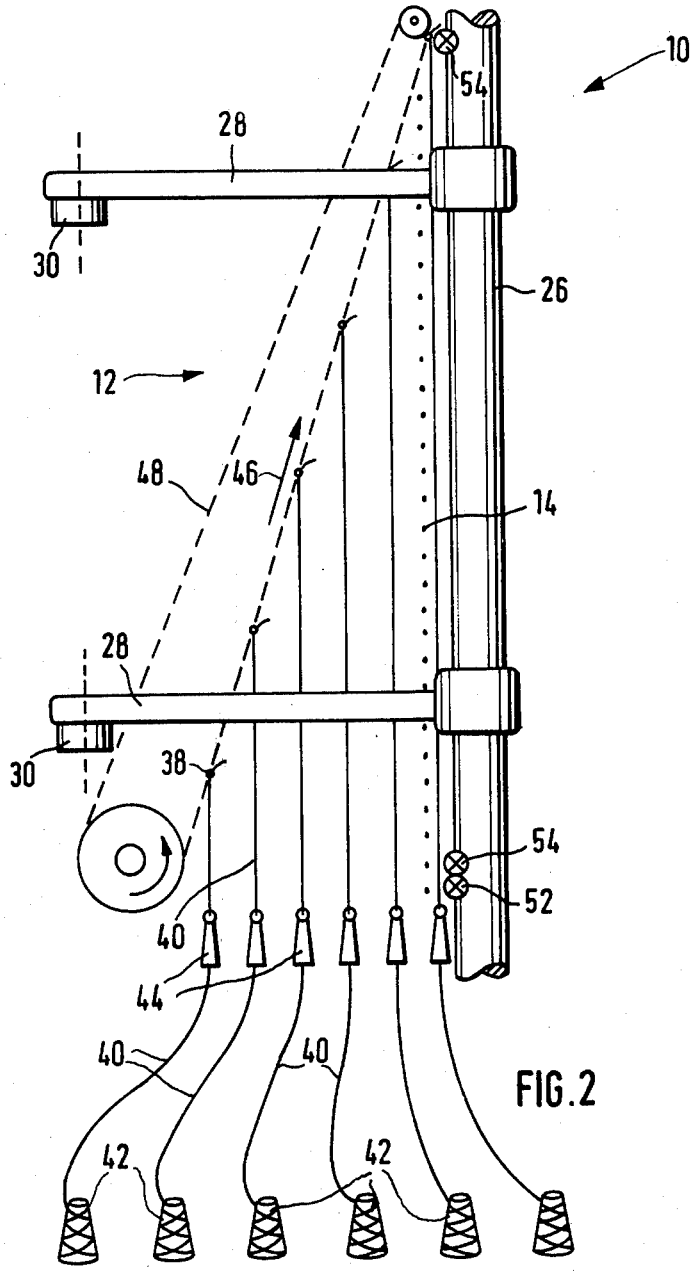

The thread transmission means, carrier means or angled transfer device 12 includes a plurality of gripper devices 38 which are used to capture the ends of the weft threads 40 taken from spools 22 which are disposed at one end of the warp knitting machine (see FIG. 2).

The thread transfer means or carrier means 12 is located (see FIGS. 1 & 2) in the space bounded in a vertical direction by drive lever 28 for the guide bars 22 and 24 and drive lever 18 for the needle bar 16; and in a horizontal direction, by the needle bed 14 and push rod 30 for the guide bars 22 and 24. The thread transfer means 12 cooperates with the threads issuing from the thread providers 44 positioned proximate the spools 42 on the side of the warp knitting machine 10.

A typical type of thread provider 44 is disclosed in German Pat. No. 2430452, which is incorporated herein in its entireity. Other types of thread providers known in the art are capable of operating in accordance with the weft inserter of the present invention, and it is not the intention to limit the use thereof to the above cited German Patent.

As soon as the threads 40 are issued from the thread providers 44 and are transferred to the transfer means 12 they are pulled out to their entire length as the transfer means continues to move in the direction of arrow 46 shown in FIG. 2. Because of the angular movement of the endless belt 48 provided on the transfer means 12, the weft threads 40 are pulled from one end of the warp knitting machine to the other end of the warp knitting machine and at the same time are moved from the rear of the machine toward the front portion of the machine in the direction of arrow 50 (FIG. 1) proximate the needle bed 14.

As soon as the threads have been extended their full length, they are already located in the immediate vicinity of the needle bed. Then utilizing a conventional cutting device 52 the threads 40 are cut and, by using a conventional gripping device 54, the threads 40 are transferred onto the needle bed 14 itself. A typical example of a convention cutting device and lay in device may be observed by referring to U.S. Pat. No. 3,916,649 to Karl Kohl.

Thus, hereinbefore has been disclosed a weft inserting apparatus for use with a warp knitting machine which dispenses with the need of a magazine apparatus to carry the threads to the needle bed, once they have been stretched the full width of the machine, thereby eliminating and simplifying the warp knitting machine and permitting a higher concentration or density of weft threads to be inserted in the knitted cloth material. While the present invention has been described with reference to a particular preferred embodiment thereof, it will be understood by those of ordinary skill in the art that the modifications may be made without departing from the spirit and scope of the invention.

Having thus set forth the nature of the invention, what is claimed is:

1. A weft inserting apparatus for use with a warp knitting machine having a needle bed, guide bar drive levers, and push rods operatively connected thereto, comprising:

(a) thread provider means for supplying a plurality of weft threads; and (b) means for sequentially carrying each of said weft threads across the width of said machine, said carrying means being angularly disposed towards said needle bed, within the space included by said needle bed, said push rods and said guide bar drive levers.

* * * * *